United States Patent [19]

Chesnick

[11] 4,048,674

[45] Sept. 20, 1977

[54] ARM GUARD FOR ARCHERS

[76] Inventor: John C. Chesnick, 4070 Marshall, Wheatridge, Colo. 80033

[21] Appl. No.: 651,229

[22] Filed: Jan. 22, 1976

[51] Int. Cl.[2] ..... A41D 13/08

[52] U.S. Cl. ..... 2/16

[58] Field of Search ..... 2/16, 20, 159, 161 R, 2/170, 24; 294/25; 273/189 R, 189 A, 54 B; 24/163, 164, 194, 197

[56] References Cited

U.S. PATENT DOCUMENTS

| | | | |
|---|---|---|---|
| 770,619 | 9/1904 | Waller | 2/16 X |
| 3,002,192 | 10/1961 | Brower | 2/16 |
| 3,304,555 | 2/1967 | Anderson et al. | 2/16 |
| 3,423,095 | 1/1969 | Cox | 2/16 X |
| 3,703,728 | 11/1972 | Saunders et al. | 2/16 |
| 3,911,497 | 10/1975 | Lewis et al. | 2/16 |

*Primary Examiner*—G. V. Larkin
*Attorney, Agent, or Firm*—John E. Reilly

[57] ABSTRACT

A protective guard for archers is adapted to be releasably and conformably fastened around the archer's forearm directly behind the hand which holds the bow with a protective strip of material extending upwardly along the forearm and having an upper free continuation which overlies a portion of the elbow when the arm is straightened so as to prevent accidental injury to the arm and elbow if the bowstring is improperly released.

8 Claims, 4 Drawing Figures

ARM GUARD FOR ARCHERS

BACKGROUND OF THE INVENTION

This invention relates to protective armguards, and more specifically relates to a protective forearm/elbow guard for archers in order to protect the archer against injury.

Archers customarily wear a forearm guard, particularly beginning archers who are prone to improperly draw back or release the bowstring. Even the slightest misalignment of the bowstring when released may cause it to slap against the elbow or forearm with a great deal of force so as to inflict considerable pain if not injury. Heretofore, forearm protectors have been designed for attachment along the forearm portion below the elbow. Typically, such protectors have a fairly solid but somewhat flexible covering or pad which is releaseably fastened at spaced intervals along the forearm by flexible straps so that the covering comformably extends along the inner fleshy portion of the forearm upwardly from the palm of the hand. While such guards afford some protection against injury, they do not protect the elbow portion which in many cases is subject to the same type of injury when the bowstring is improperly released, and this is especially true with respect to the side of the ulna at its connection to the humerus. Constant bending or movement of the arm has in the past discouraged any type of elbow protector or guard and it is therefore important that any such type of guard not impose a restriction on free movement of the arm, for example, in reloading the bow or in flexing or bending of the arm for other purposes.

SUMMARY OF THE INVENTION

Accordingly, it is an object of the present invention to provide for a novel and improved arm guard to prevent accidental injury to the arm and elbow in archery.

It is another object of the present invention to provide an arm guard for archers which can be easily attached to and removed from the forearm directly behind the hand holding the bow while affording complete protection from accidental injury both to the forearm and elbow when the bowstring is improperly released.

It is a further object of the present invention to provide a protective shield for archers which is of simplified construction, economical to manufacture and is readily attachable to the forearm of the archer to protect both the forearm and the elbow from accidental injury without limiting free movement or bending of the arm.

In accordance with the present invention, a preferred form of arm guard for archers has been devised in which a covering or shield is releasably attached along the inside or fleshy portion of the forearm so as to closely conform to the configuration of the forearm, and the covering includes an upward continuation in the form of a generally concave extension which overlies and closely conforms to the side of the elbow without attachment to the arm. In this way, the elbow shield is free to follow movement of the rest of the arm guard when the arm is bent or twisted; and when the arm is straightened the elbow shield will automatically return into position overlying the side of the elbow facing the bowstring so as to shield it against accidental injury which might otherwise be caused by improper release of the bowstring.

The above and other objects, advantages and features of the present invention will become more readily appreciated and understood from a consideration of the following detailed description of preferred and alternate forms when taken together with the accompanying drawings, in which:

DETAILED DESCRIPTION OF THE PREFERRED EMBODIMENTS

Figure 1:
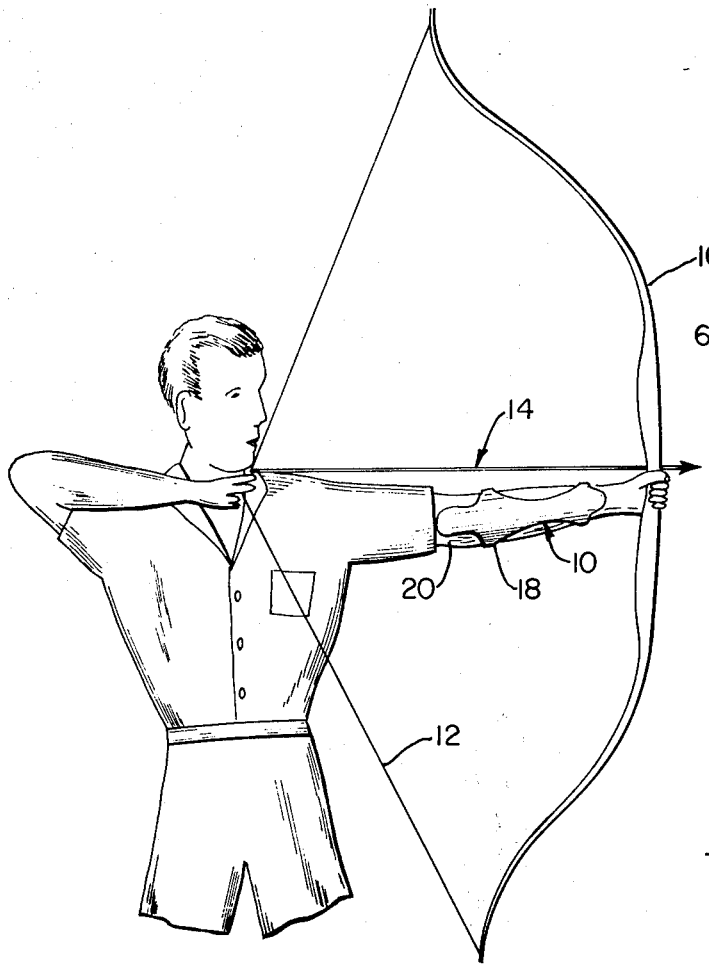
FIG. 1 is a view illustrating placement of the arm guard on an archer's forearm in use.

Referring in more detail to the drawings, and as a setting for the present invention, FIG. 1 illustrates the manner of placement of an arm guard 10 on the forearm of an archer so as to be disposed in facing relation to the path of travel of a bowstring 12 in shooting an arrow 14. The bow 16 is grasped so that the bowstring 12, if improperly released, has a tendency to spring forward with a great deal of force against the inside or fleshy portion of the forearm as designated at 18 as well as the inner side of the elbow 20. By "inner side" is meant that portion of the arm or elbow which normally would face inwardly toward the body when the arm is in a relaxed state or extending downwardly along the body with the palm facing inwardly toward the body. As illustrated, when the left hand of a right-handed archer grasps the bow, the inner portion of the forearm and the elbow of the left arm is exposed to possible injury when the bowstring 12 is improperly released. This is particularly true with respect to beginning archers who do not maintain proper alignment of the bowstring in drawing it rearwardly as a preliminary to shooting the arrow. If the bowstring 12 is misaligned somewhat when the arrow is released, it will tend to snap or slap against the exposed portion of the arm with a great deal of force.

Figure 2:
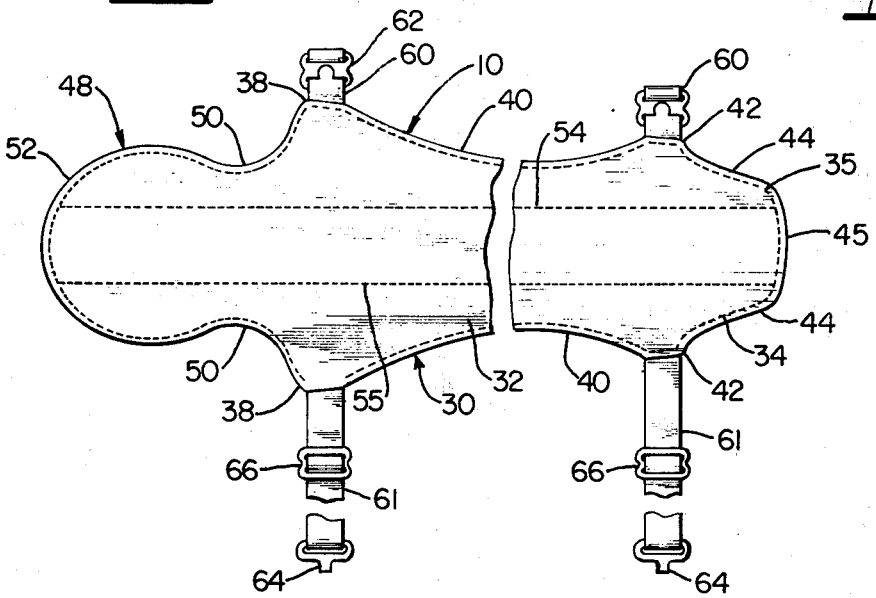
FIG. 2 is a plan view of the preferred form of arm guard in accordance with the present invention.

It is therefore highly desirable to shield both the arm and elbow against such possibility of injury but to do so in a way that will permit complete freedom of bending or twisting of the arm. To this end, a preferred form of arm guard 10 has been devised as shown in more detail in FIGS. 2 and 3 and is seen to comprise a main body portion 30 having an outer shield 32 composed of a tough but somewhat flexible material such as leather and an inner padding 34 which is suitably composed of a fabric or spongy, resilient material if desired and which is stitched along its outer periphery to the outer peripheral edge of the shield 32 as designated at 35. Preferably, the main body is contoured to conform to the tapered configuration of the forearm from a point below the elbow joint down to the wrist and therefore has a relatively wide portion 38 merging or tapering downwardly, or forwardly, as defined by the inwardly curving or concave side edges 40 and increasing somewhat in width at side portions 42 then once again tapering forwardly as defined by the side edges 44 into a forward rounded terminal end 45. An important feature of the present invention resides in the upper longitudinal extension 48 of the arm guard 10 which is formed as an upwardly convergent continuation of the wider portion 38 of the arm guard 10. Specifically, the wider portion converges inwardly into a neck defined by the inwardly curving side edges 50 and a somewhat enlarged rounded cap or convex head 52. As shown, the extension 48 is correspondingly constructed of the same material as the outer shield 32 and inner padding 34 of the main body portion and in the preferred form as shown is of one-piece construction. In addition, medial, longitudinally extending seams 54 and 55 are seen to extend in closely spaced relation to one another along the entire extent of the arm and elbow guard, which seams join the inner padding 34 to the outer shield 32 so as to more closely unite the two layers together.

Figure 3:
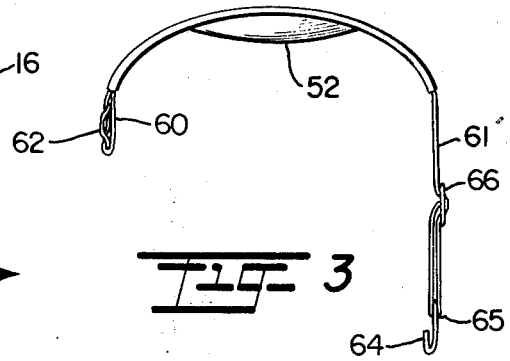
FIG. 3 is an end view of the arm guard shown in FIG. 2.

Although the arm guard may normally lay somewhat flat when in a relaxed condition, it is of sufficient flexibility that when applied to the arm it has the ability to conform to the rounded configuration of the forearm in the manner shown in FIG. 3. In addition, the upper extension 48 is most desirably preshaped to have a slight concavity in inwardd facing relation to the elbow so as to snugly fit around the elbow joint and specifically at the juncture of the ulna, or larger bone of the forearm, to the humerus. In this relation, the main body portion 30 of the arm guard 10 is dimensioned so that at its wider portions 38 and 42 it will embrace or surround substantially one-half of the forearm.

In order to releasably attach the main body portion to the forearm, fastening means in the form of flexible straps 60 and 61 are sewn or otherwise connected to the wider portions 38 and 42 as shown and have complementary fastener elements at their opposite free ends. Thus, each strap 60 may suitably include a slotted or female fastener 62 which is adapted to receive a hook end portion 64 of a male fastener 65 on the strap 61. In addition, the strap 61 may be provided with a conventional type of length adjuster 66.

Figure 4:
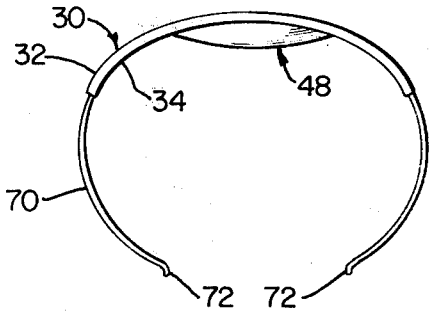
FIG. 4 is an end view of a modified form of arm guard in accordance with the present invention.

A modified form of invention is illustrated in FIG. 4 in which the main body portion 30 and upper extension 48 are formed in a manner corresponding to that described with reference to the preferred form and accordingly like parts are correspondingly enumerated. However, in the modified form of fastener as illustrated in FIG. 4 spring-like bands or clips 70 are employed as releasable fasteners in place of the straps 60 and 61 illustrated in FIGS. 2 and 3. Although not specifically shown, each band or clip 70 is of a width corresponding to that of the straps 60 and 61, and each is composed of a strong, durable plastic or spring steel material of limited resiliency which is relatively thin and of generally oval-shaped configuration and terminating in spaced apart outwardly bent or rounded terminal ends 72. Further, each band or clip 70 is embedded in the main body portion of the arm guard so as to extend continuously in a lateral direction between the inner padding 34 and outer shield 32; and in a conventional manner may be positioned in fixed relation by suitable stitching, not shown, between the padding 34 and shield 32 along opposite side edges of each band or clip. In the modified form, the spring clips greatly facilitate placement of the arm guard by spreading the free terminal ends 72 and forcing over the forearm until they spring back in place so as to position the arm guard in the relationship to the arm as illustrated in FIG. 1.

Both with respect to the preferred and modified forms of invention described, it is emphasized that the specific configuration of the main body portion as well as the fasteners may be varied or altered without departing from the scope of the present invention, although the specific form of main body portion as described lends itself particularly well for use in combination with the upper extension shield 48. Further, the main body portion 32 and upper extension 48 may be composed of various materials in achieving the desired objectives and features of the present invention. It is therefore to be understood that various modifications and changes may be made in the construction and arrangement of elements comprising preferred and alternate forms of the present invention without departing from the spirit and scope thereof and defined by the appended claims.

What is claimed is:

1. An arm guard for archers comprising an elongated forearm cover portion having fastener means adapted to be drawn together around the forearm of the wearer so that said forearm cover portion conformably surrounds the inner side of the wearer's forearm, an elbow covering forming a longitudinal continuation of said forearm cover portion, said elbow covering adapted to overlay and conform to the configuration of the inner side of the elbow joint when the arm of the wearer is straightened, said elbow covering being unattached to the arm of the wearer so as to be free to allow movement of said main forearm portion when the arm is flexed or twisted, said elbow covering being of relatively shallow concave configuration and having an external, rounded peripheral edge.

2. An arm guard according to claim 1, said fastener means being defined by fastening straps on opposite sides of said main body portion at spaced lengthwise intervals, said straps including connectors at their free ends adapted to be interconnected and drawn closely together around the wearer's forearm.

3. An arm guard according to claim 1, said fastener means defined by spring clips at spaced lengthwise intervals along said main body portion, said spring clips each being of generally oval-shaped configuration and terminating in free rounded terminal ends in closely spaced relation to one another, said spring clips being of sufficient resiliency as to permit spreading of the terminals ends in passing over the wearer's forearm into closely surrounding relation thereto.

4. An arm guard according to claim 1, said forearm cover portion and elbow covering defined by a one-piece outer shield composed of a leather or leather-like material of limited flexibility and an inner padding coextensive with said outer shield, said elbow covering being in the form of a rounded cap converging into a neck at its connection to said forearm cover portion.

5. An arm guard according to claim 4, said elbow covering having an inner concave surface adapted to be disposed in facing relation to the elbow joint so as to closely conform to and surround the inner side of the elbow.

6. An arm guard according to claim 1, said forearm cover portion being in the form of an elongated, thin flexible shield having opposite longitudinally extending side portions tapering in width in a direction away from said elbow covering.

7. A protective arm guard for archers comprising:

a longitudinally extending protective shield having a main body defining a forearm cover portion and an elbow covering portion, said forearm cover portion providing an inner curved surface adapted to extend along the greater length of the inner side of the forearm between the elbow and wrist of the wearer, and said elbow covering portion providing an inner concave surface forming a lengthwise continuation of said forearm cover portion and converging in a direction away from said forearm cover portion adapted to overlay and conform to the configuration of the inside of the elbow joint of the wearer, said forearm cover portion tapering in width in a direction away from said elbow covering portion and having opposite side portions of increased width at longitudinally spaced intervals along said forearm cover portion, and fastener means extending from the opposite side portions of increased width adapted to be drawn together around the forearm of the wearer whereby said forearm cover portion conformably surrounds the inner side of the wearer's forearm, said elbow covering portion being unattached to the arm of the wearer so as to be free to follow movement of said forearm cover portion.

8. A protective arm guard according to claim 7, said fastener means defined by flexible straps having free ends and interconnecting portions at the free ends.

* * * * *